United States Patent [19]

Daugherty

[11] 4,439,164

[45] Mar. 27, 1984

[54] PADDLE WHEEL KIT FOR PONTOON BOAT

[76] Inventor: Don D. Daugherty, 9535 Five Mile Rd., Northville, Mich. 48167

[21] Appl. No.: 296,819

[22] Filed: Aug. 27, 1981

[51] Int. Cl.[3] ..... B63H 1/04

[52] U.S. Cl. ..... 440/91; 440/90

[58] Field of Search ..... 440/90–93

[56] References Cited

U.S. PATENT DOCUMENTS 2,674,971 4/1954 Therrieli ..... 440/90

2,711,708 6/1955 Thornburg ..... 440/91

2,907,296 10/1959 Roby ..... 440/90

3,031,692 5/1962 Riek ..... 440/91

*Primary Examiner*—Trygve M. Blix

*Assistant Examiner*—C. T. Bartz

*Attorney, Agent, or Firm*—Basile, Weintraub & Hanlon

[57] ABSTRACT

A power assembly for converting a conventional commercial pontoon boat usually driven with an outboard motor to a paddle wheel driven boat.

3 Claims, 3 Drawing Figures

PADDLE WHEEL KIT FOR PONTOON BOAT

BACKGROUND OF THE INVENTION

This invention is related to pontoon boats and more particularly to an assembly for converting a conventional propeller driven boat to a stern wheeler boat by removing the support for the propeller driven engine and attaching a U-shaped support to the rear of the pontoon boat frame for supporting a paddle wheel in a position between the rearward ends of the pontoons.

SUMMARY OF THE INVENTION

Pontoon boats are very popular and usually comprise a pair of elongated pontoons, a frame mounted on the pontoons, and a deck mounted on the frame for supporting the passengers. Frequently, a steering wheel is mounted on the deck with telescopic linkage means connected to an outboard motor mounted between the rear ends of the pontoons.

The broad purpose of the present invention is to provide means for converting a standard commercial pontoon boat from a propeller driven power means to a paddle wheel boat by attaching a U-shaped support to the rear of the frame on which the conventional engine is mounted, mounting an engine driven paddle wheel between the two legs of the support, and a pair of rudders rearwardly of the paddle wheel for steering the boat by means of a linkage connecting the steering wheel to the rudders. The preferred assembly is adaptable for most commercial size pontoon boats ranging from 21 feet up to 40 feet in length and includes a paddle wheel, a transmission, a clutch, an engine, and a rudder assembly and a U-shaped support for mounting the paddle wheel components on the pontoon boat frame.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
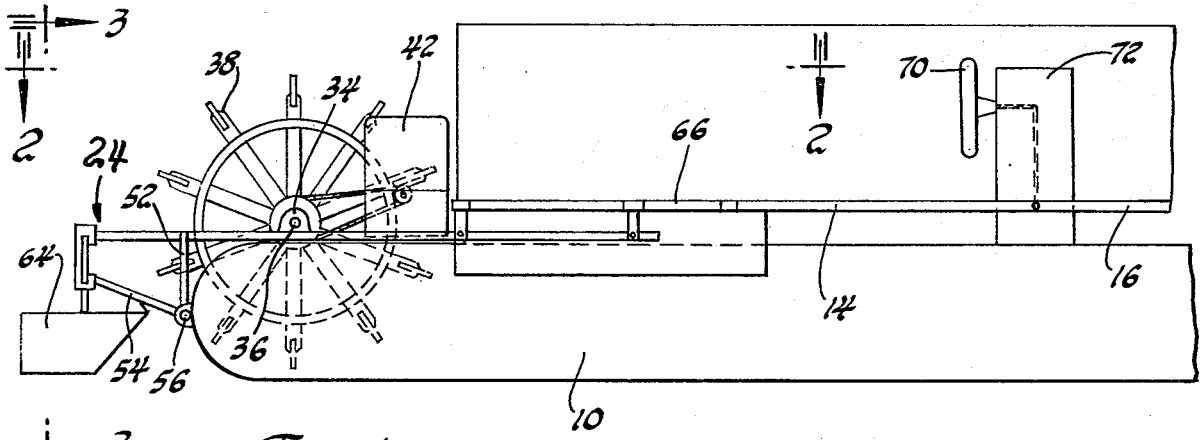
FIG. 1 is a side elevational view of a paddle wheel assembly mounted on a pontoon boat in accordance with the invention.
Figure 2:
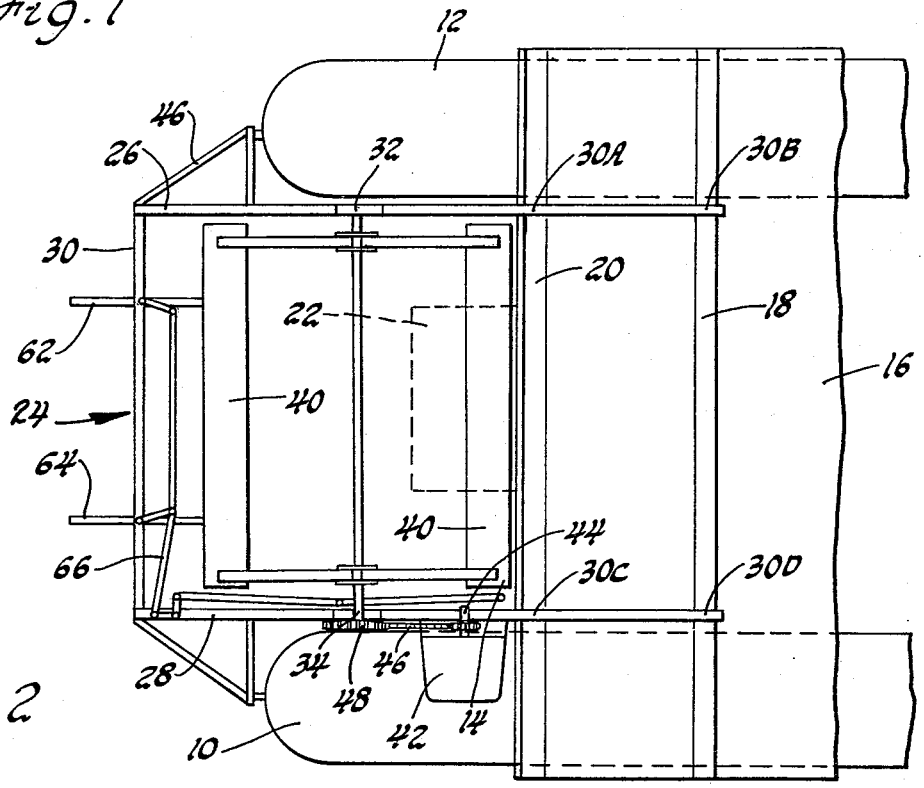
FIG. 2 is a fragmentary plan view of the paddle wheel boat.
Figure 3:
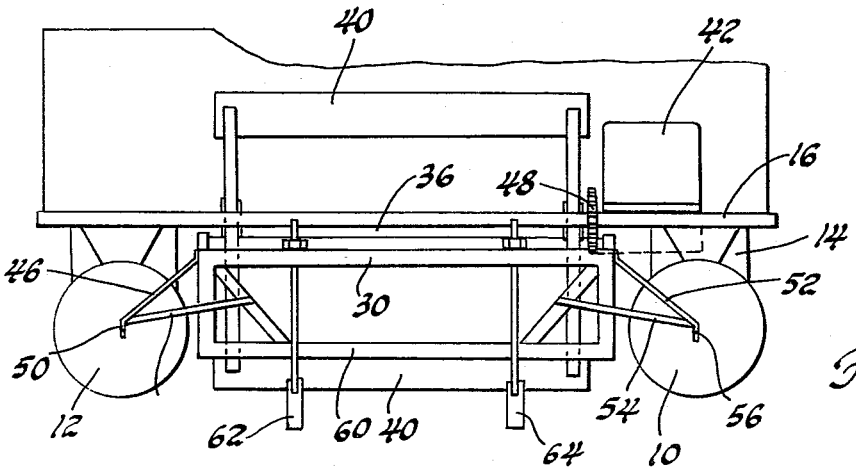
FIG. 3 is a rear end view of the preferred paddle wheel boat.

Referring to the drawings, FIG. 1 illustrates a pontoon boat as comprising a pair of elongated hollow pontoons 10 and 12. Frame 14 is mounted on the pontoons and a deck 16 is mounted on the frame. As best illustrated in FIG. 2, the rearward ends of the pontoon extend beyond the rear end of frame 14 and deck 16.

Frame 14 includes a pair of parallel spaced cross members 18 and 20. Many commercial pontoon boats are made with a support 22 (illustrated in phantom) for mounting an outboard motor between the pontoons. Support 22 is removed and a U-shaped support 24 having a pair of spaced legs 26 and 28 and cross member 30 is removably connected at positions 30A, 30B, 30C and 30D to cross members 18 and 20.

A pair of bearings 32 and 34 are mounted on legs 26 and 28, respectively. A shaft 36 has its ends mounted on bearings 32 and 34. Paddle wheel means 38, preferably having thin paddle blades 40, are mounted on shaft 36. The shaft is supported in a position such that the paddles are immersed into the water as the paddle wheel is rotated. Preferably the inner edge of each blade is level with the water's surface when the blade is immersed in the water to avoid splashing.

Engine means 42 are mounted on support leg 28. The engine means includes a transmission and clutch and has an output shaft 44 connected by chain means 46 to sprocket 48 carried on shaft 36. The transmission is adapted to drive the paddle wheel in forward or reverse, and also has a neutral position.

Rear cross member 30 has one end connected by a pair of struts 46 and 48 to the rearward-most tip 50 of pontoon 12. The opposite end of cross member 30 is connected by a pair of struts 52 and 54 to the rearward-most tip 56 of pontoon 10.

A lower support member 60 is mounted on cross member 30. A pair of rudders 62 and 64 are mounted on support cross members 30 and 60. Linkage means 66 connect the upper ends of the two rudders to a helm 70 mounted on an upright support 72 carried on the boat's deck. The linkage may be readily connected to the existing boat controls provided on most commercially available pontoon boats for steering the outboard motor. Mounting the rudders immediately behind the paddle wheel means provides the boat with a great deal of maneuverability so that it can be turned in a very tight circle. The preferred kit assembly provides means for readily converting a standard commercial pontoon boat from propeller driven power means to a paddle wheel drive means.

The preferred pontoon boat can be operated on lakes having a considerable quantity of weeds that make it difficult for a conventional boat with a standard outboard motor to operate. A 26 foot boat can economically operate several hours with a 5 horsepower engine driving the paddlewheel.

Having described my invention, I claim:

1. A paddle wheel power assembly for use with a boat having a pair of spaced, elongated pontoons, frame means mounted on the pontoons, a steering control member, a steering linkage, a deck mounted on the frame means, the paddle wheel power assembly comprising:

support means suited for connection to the frame means in a position between the pontoons adjacent the rear ends thereof, the support means including:

a pair of spaced, parallel support legs mountable on the boat;

a cross member secured to and extending between one end of the pair of legs rearwardly of the deck;

bearing means mounted on the support legs; and a shaft having its ends rotatably mounted on the bearing means;

paddle wheel means mounted on the shaft;

engine means drivingly connected to the shaft for rotating the shaft and the paddle wheel means; and rudder means mounted on the cross member rearwardly of the paddle wheel means.

2. The paddle wheel power assembly as defined in claim 1 in which the engine means is mounted on one of the support legs.

3. A method for converting a pontoon boat having a pair of spaced, parallel, elongated pontoons, a frame mounted on the pontoons, engine support means mounted on the frame between the pontoons, a steering control member mounted on the frame and a steering linkage connected to the steering control member, comprising the steps of removing the engine support means, removably mounting a paddle wheel power assembly including support means having spaced pair of legs, a crossmember secured to and extending between one end of the pair of legs, bearing means, a rotatable shaft, a paddle wheel mounted on the shaft, engine means drivingly connected to the shaft and rudder means mounted on the cross member rearwardly of the paddle wheel, by attaching the spaced pair of legs of the support means to the frame, and connecting the steering linkage of the rudder means for moving the rudders means between selected steering positions.

* * * * *